US006131314A

United States Patent [19]

Pelfrey et al.

[11] Patent Number: 6,131,314

[45] Date of Patent: Oct. 17, 2000

[54] PLANT SHOE FOR PLACEKICKERS AND METHOD OF USE THEREOF

[75] Inventors: Robert Pelfrey; Raymond Pelfrey, both of Sparks, Nev.

[73] Assignee: Professional Kicking Services, Inc., Sparks, Nev.

[21] Appl. No.: 09/207,334

[22] Filed: Dec. 8, 1998

Related U.S. Application Data

[60] Provisional application No. 60/067,950, Dec. 8, 1997.

[51] Int. Cl.[7] ..... A43B 5/02; A43B 13/12; A43B 13/18

[52] U.S. Cl. ..... 36/128; 36/30 R; 36/28

[58] Field of Search ..... 36/128, 30 R, 36/28, 130, 127, 140, 141, 142, 81

[56] References Cited

U.S. PATENT DOCUMENTS

| | | | |
|---|---|---|---|
| 1,391,346 | 9/1921 | Schwarzer | 36/128 |
| 1,602,452 | 10/1926 | Riddell . | |
| 2,002,869 | 5/1935 | Riddell . | |
| 2,098,468 | 11/1937 | Shapiro | 36/128 |
| 2,773,316 | 12/1956 | Clappier . | |
| 2,904,903 | 9/1959 | Kardon . | |
| 3,333,352 | 8/1967 | Livingston | 36/128 |
| 3,341,952 | 9/1967 | Dassler | 36/128 |
| 4,255,877 | 3/1981 | Bowerman | 36/128 |
| 4,676,010 | 6/1987 | Cheskin | 36/30 R |
| 4,787,156 | 11/1988 | Bade | 36/128 |
| 4,890,397 | 1/1990 | Harada et al. | 36/30 R |
| 5,077,916 | 1/1992 | Beneteau | 36/128 |
| 5,216,824 | 6/1993 | Blissett et al. | 36/28 |
| 5,255,453 | 10/1993 | Weiss | 36/134 |

*Primary Examiner*—Paul T. Sewell
*Assistant Examiner*—Anthony Stashick
*Attorney, Agent, or Firm*—Larson & Taylor, PLC

[57] ABSTRACT

A plant shoe and a method of use thereof to be worn on the plant foot of a placekicker wearing a kicking shoe having a total sole thickness s on his kicking foot, wherein the plant shoe includes a main sole, a filler sole adjacent said main sole, wherein the main sole and the filler sole together have a thickness greater than s, and a plurality of cleats positioned on an underside of either the main sole or the filler sole for engaging the playing surface. In one embodiment the cleats are positioned on the underside of the main sole and in an alternate embodiment, the main sole is positioned between a shoe upper and the filler sole and the cleats are positioned on the underside of the filler sole.

7 Claims, 2 Drawing Sheets

PLANT SHOE FOR PLACEKICKERS AND METHOD OF USE THEREOF

This application claims benefit of the filing date of copending Provisional Patent Application Ser. No. 60/067,950 filed Dec. 8, 1997, of which is herein incorporated by reference.

FIELD OF THE INVENTION

The present invention relates to shoes to be worn by placekickers in a sport such as football and, in particular, to a shoe to be worn on the plant foot of a placekicker.

BACKGROUND OF THE INVENTION

One of the most difficult physical techniques for a placekicker, whether European style, soccer style, American wedge, or conventional kicker (straight-on toe kicker) is to achieve proper or close to maximum hitting height on the football. The controlling factor for this is the position of the plant foot with respect to the ball, which, in part, determines the upward arc of the kicking foot. Because a kicker moves forward to the ball in an aggressive manner, overrunning of the plant foot position is the most common kicking error.

SUMMARY OF THE INVENTION

The present invention is a plant shoe and a method of use thereof, and a plant shoe in combination with a kicking shoe. The plant shoe of the invention is for placekickers and it enhances a placekicker's effectiveness in kicking a football or the like. The invention comprises a filler sole which raises the placekicker's plant foot above the playing surface to a height greater than that effected by a normal plant shoe. In a preferred embodiment, a filler sole is positioned between an upper and a main sole, wherein the main sole comprises cleats for gripping the playing surface. In an alternative embodiment, the filler sole is positioned on the underside of the main sole and the cleats attach to the underside of the filler sole. The filler sole serves to raise the placekicker's plant foot above the playing surface to a sufficient height such that when the placekicker kicks the ball with his or her kicking foot, the kicking foot will strike the ball at a higher position than if the placekicker were wearing a normal prior art plant foot shoe.

In a preferred embodiment, the filler sole is made of a resilient material, having a durometer hardness somewhat less than the main sole. While the filler sole may be of any particular height that suits the kicking needs of a particular kicker, in a preferred embodiment, the filler sole has a thickness of between ⅛ inch and 1 inch and, more particularly, between ½ inch and ⅞ inch. Advantageously, the plant shoe is constructed such that one of a plurality of filler soles having various thickness may be employed such that the height of a plant shoe may be adjusted to fit a particular need.

By raising the overall height of the kicker's plant foot, the striking arc to the gut of the ball with the kicking foot will be higher and, preferably, just below the center line which involves the largest ball surface, i.e., the "sweet spot." The distance the ball travels is a function of the mass of the foot and the ball and the acceleration of the kicking foot as well as the place on the ball where the kicking foot impacts the ball. Impacting the ball at or near the "sweet spot" provides improved distance on the kick as well as improved hang time. The present invention provides correction when a kicker "overplants" or goes past the ball with his plant foot, which results in undercutting the ball.

Other features and advantages of the invention will become apparent from the detailed descriptions of preferred embodiments of the invention which follow, taken in conjunction with the accompanying drawings, wherein like numerals designate like elements throughout the several views.

DETAILED DESCRIPTION OF THE PREFERRED EMBODIMENTS

Figure 1:
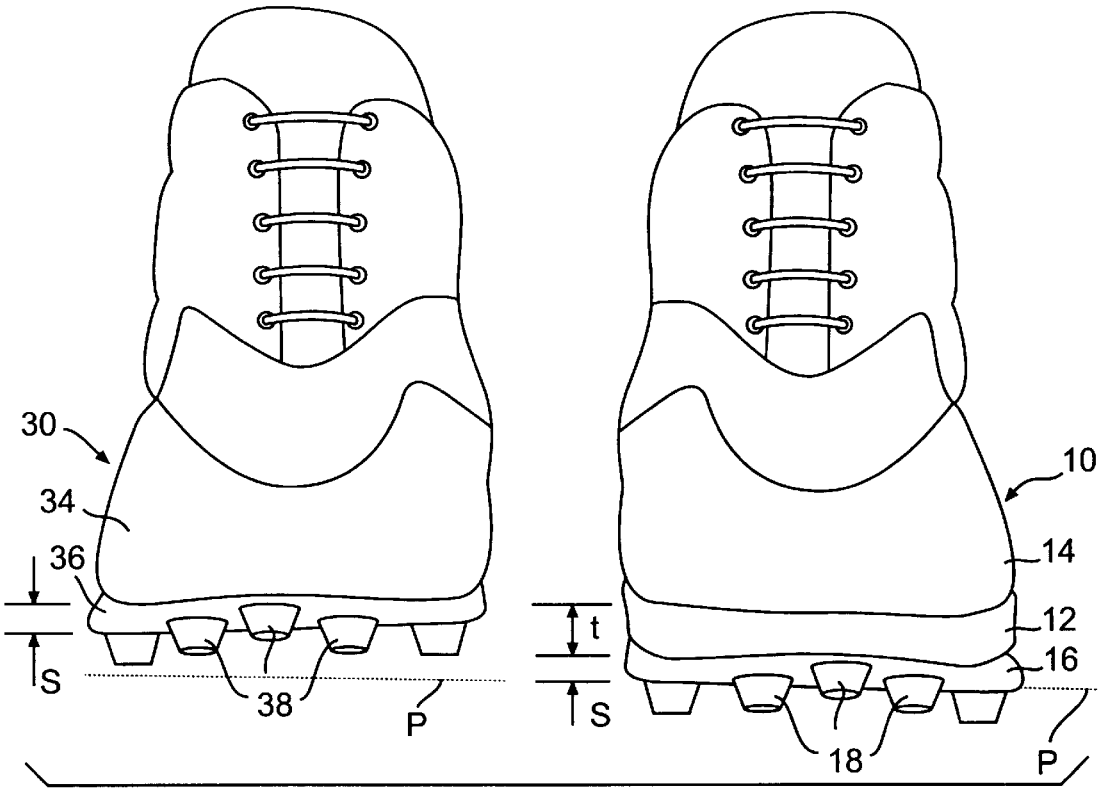
FIG. 1 is a front elevational view of a pair of shoes in accordance with a preferred embodiment of the invention.
Figure 2:
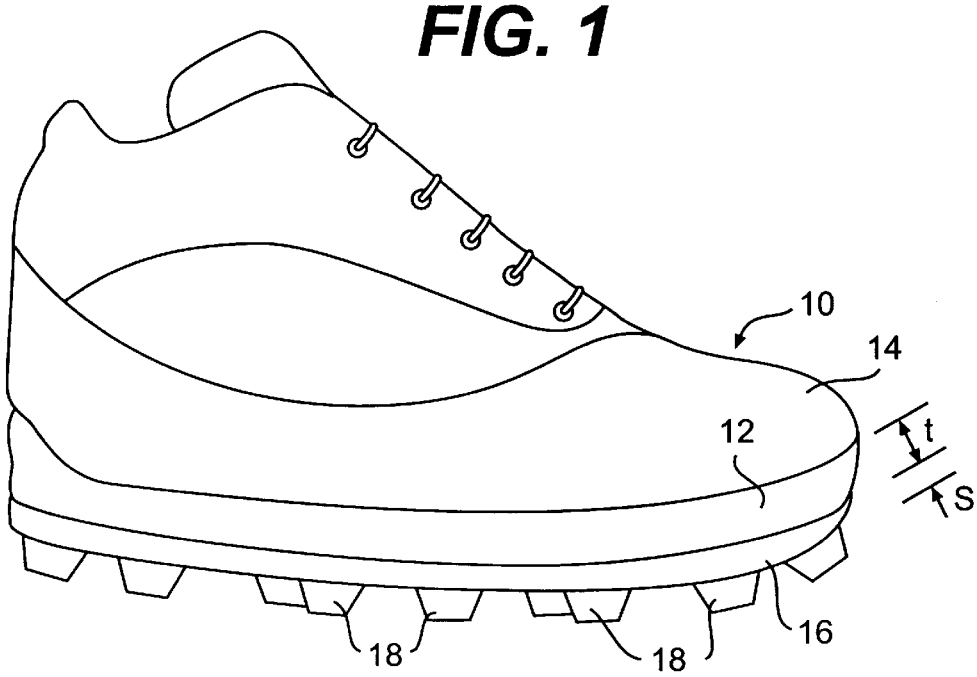
FIG. 2 is a side elevational view of the plant shoe shown in FIG. 1.

FIG. 1 shows a pair of shoes in accordance with a preferred embodiment of the invention. Kicking shoe 30, shown in FIG. 1 as the right shoe (although it may be the left shoe for a particular kicker), comprises upper 34, sole 36 and cleats 38 positioned on the underside of sole 36. Sole 36 has a thickness of approximately s. While a particular design of kicking shoe 30 is shown, any type of kicking shoe, e.g., square toe, etc. could be used. Plant shoe 10, shown in FIG. 1 as the left shoe and shown in side elevational view in FIG. 2, comprises upper 14, main sole 16, having cleats 18 on the underside thereof, and filler sole 12. Main sole 16 has a thickness of approximately s and filler sole 12 has a thickness of approximately t. Thickness t is approximately ⅛ inch to 1 inch and preferably ½ inch to ⅞ inch. As shown in FIG. 1, with the inclusion of filler sole 12, plant shoe 10 raises the plant foot above the playing surface P to a height greater than that of a normal plant shoe (which would generally have a total sole thickness of approximately s to match kicking shoe 30). As further shown in FIG. 1, when plant shoe 10 engages playing surface P, kicking shoe 30, worn on the kicking foot, swings above playing surface P, thus striking higher on the ball than normal.

Figure 3:
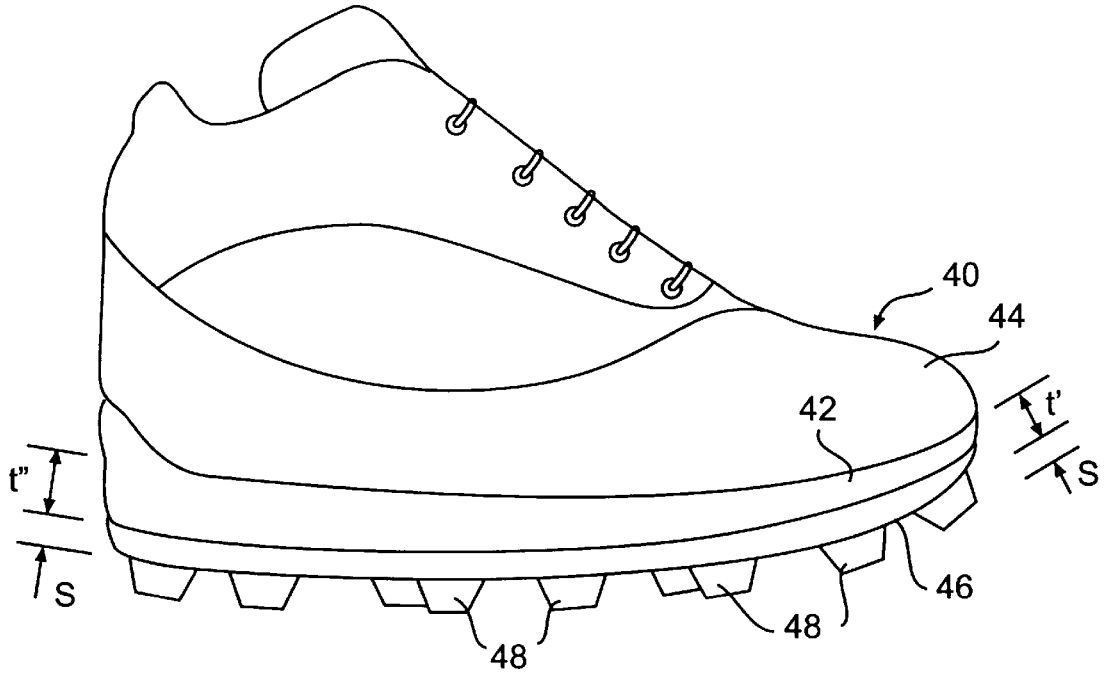
FIG. 3 is a side elevational view of a plant shoe in accordance with a second embodiment of the invention.

FIG. 3 shows an alternative embodiment of the plant shoe of the invention wherein the filler sole is of varying thickness. As in the embodiment of FIG. 1, filler sole 42 of plant shoe 40 is positioned between upper 44 and main sole 46 which has cleats 48 thereon. Main sole 46 has a thickness of approximately s and filler sole 42 has a varying thickness ranging from t' at the toe portion to t" at the heel portion. Alternatively, the thickness of filler sole 42 may vary from side to side, may be greater in the toe portion than in the heel portion, or may vary in any other manner to suit the application of a particular kicker.

Figure 4:
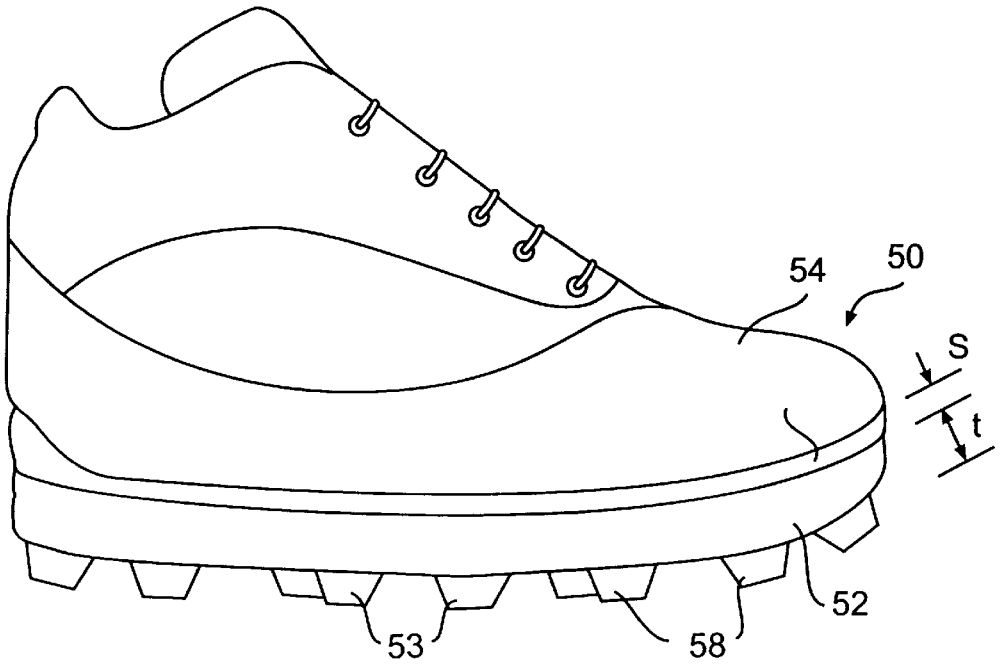
FIG. 4 is a side elevational view of a plant shoe in accordance with a third embodiment of the invention.

FIG. 4 shows a side elevational view of a third embodiment of the plant shoe of the invention. In this embodiment, plant shoe 50 comprises upper 54, main sole 56 attached to upper 54, and filler sole 52 attached to the underside of main sole 56. Cleats 58 are attached to the underside of filler sole 52 and main sole 56 has a thickness of approximately s. While, as shown, filler sole 52 has a thickness t, filler soles with alternative thicknesses or variable thickness may advantageously be utilized. One advantage of this embodiment is that various filler soles may more easily be releasably or permanently attached to plant shoe 50 by screws or any other attachment mechanism. Cleats 58 may be molded into filler sole 52 or may attach by threads, etc.

Although each of the plant shoes described above include a main sole and a filler sole, the main sole and the filler sole may alternatively be formed as a single sole.

Although the invention has been described in detail with respect to preferred embodiments thereof, it will be understood by those skilled in the art that variations and modifications can be effected in these preferred embodiments without departing from the spirit and scope of the invention.

What is claimed is:

1. A combination of a kicking shoe and a plant shoe comprising:

a kicking shoe having a total sole thickness s; and a plant shoe comprising a main sole, a filler sole adjacent said main sole, wherein said main sole and said filler sole together have a thickness of between approximately (s+½ inch) and (s+1 inch), and a plurality of cleats positioned on an underside of said main sole and said filler sole for engaging a playing surface.

2. A pair of shoes as in claim 1, wherein said filler sole of said plant shoe is positioned between an upper and said main sole of said plant shoe and said plurality of cleats are positioned on said underside of said main sole.

3. A plant shoe as in claim 1, wherein said main sole of said plant shoe is positioned between an upper and said filler sole of said plant shoe and said plurality of cleats are positioned on said underside of said filler sole.

4. A combination as in claim 1, wherein said filler sole of said plant shoe is made of a softer material than that of said main sole of said plant shoe.

5. A method of kicking a ball with a kicking foot while planting a plant foot on a playing surface, said method comprising:

wearing on said kicking foot a kicking shoe having a total sole thickness S;

wearing on said plant foot a plant shoe comprising a main sole, a filler sole adjacent said main sole, wherein said main sole and said filler sole together have a thickness of between (S+½ inch) and (S+⅞ inch), and a plurality of cleats positioned on an underside of one of said main sole and said filler sole for engaging the playing surface;

planting said plant shoe adjacent the ball; and kicking the ball with said kicking shoe.

6. A method of kicking a ball as in claim 5, wherein said filler sole of said plant shoe is positioned between an upper and said main sole of said plant shoe and said plurality of cleats are positioned on said underside of said main sole.

7. A method of kicking a ball as in claim 5, wherein said main sole of said plant shoe is positioned between an upper and said filler sole of said plant shoe and said plurality of cleats are positioned on said underside of said filler sole.

* * * * *